US006691901B2

(12) United States Patent
Parve et al.

(10) Patent No.: US 6,691,901 B2
(45) Date of Patent: Feb. 17, 2004

(54) CLOSURE FOR A CONTAINER

(75) Inventors: Terrence M. Parve, Menomonee Falls, WI (US); William C. Vogel, Milwaukee, WI (US)

(73) Assignee: Gateway Plastics, Inc., Mequon, WI (US)

( * ) Notice: Subject to any disclaimer, the term of this patent is extended or adjusted under 35 U.S.C. 154(b) by 0 days.

(21) Appl. No.: 10/020,581

(22) Filed: Dec. 14, 2001

(65) Prior Publication Data

US 2003/0111495 A1 Jun. 19, 2003

(51) Int. Cl.[7] ..... B65D 47/00

(52) U.S. Cl. ..... 222/556; 222/480; 222/565; 220/254.2; 220/254.3; 215/245

(58) Field of Search ..... 222/153.14, 556, 222/565, 536, 530, 498, 480; 220/254.2, 254.3, 835; 215/237, 245

(56) References Cited

U.S. PATENT DOCUMENTS

| | | | |
|---|---|---|---|
| 181,615 | A | 8/1876 | Albertson |
| 199,896 | A | 2/1878 | Burger |
| 785,116 | A | 3/1905 | Perry |

(List continued on next page.)

FOREIGN PATENT DOCUMENTS

| | | |
|---|---|---|
| FR | 1153553 | 5/1958 |
| GB | 2120219 | 11/1983 |

OTHER PUBLICATIONS

Graphic Images: Closure #1, document No. 001.1351076.1.
Graphic Images: Closures #2, document No. 001.1351077.1
Graphic Images: Closure #3, document No. 001.1351113.1.
Graphic Images: Closure #4, document No. 001.1351083.1.
Graphic Images: Closure #5, document No. 001.1351087.1.
Graphic Images: Closure #6, document No. 001.1351089.1.
Graphic Images: Closure #7, document No. 001.1351090.1.
Graphic Images: Closure #8, document No. 001.1351092.1.
Graphic Images: Closure #9, document No. 001.1351093.1.
Graphic Images: Closure #10, document No. 001.1351094.1.
Graphic Images: Closure #11, document No. 001.1332135.1.
Graphic Images: Closure #12, document No. 001.1332135.1.
Graphic Images: Closure #13, document No. 011.1384042.1.
Amended Complaint, Gateway Plastics, Inc. v. Weatherchem Corporation, Case No. 02–C–0870.
Answer and Counterclaim, Gateway Plastics, Inc. v. Weatherchem Corporation, Case No. 02–C–0870.

*Primary Examiner*—Gene Mancene
*Assistant Examiner*—Frederick C. Nicolas
(74) *Attorney, Agent, or Firm*—Foley & Lardner

(57) ABSTRACT

A retainer is disclosed for a closure for a container, having a base portion and flaps for covering and uncovering dispensing openings. The retainer includes an interface coupled to the flap and configured to provide an interference with the base and a member coupled to the interface and configured to engage an edge of the base to eliminate the interference when the flap is moved to a closed position.

A method of securing a flap to a closure for a container is disclosed and includes providing a flap hinged to the closure, coupling an interface to the flap, configuring the interface to provide at least a partial interference with a portion of the closure in a first position, providing a guide on the interface configured to engage an edge of the closure in the first position and eliminating the interference when the flap is moved to a second position.

34 Claims, 8 Drawing Sheets

U.S. PATENT DOCUMENTS 847,726 A 3/1907 Brannon
893,469 A 7/1908 Essmuller
947,025 A 1/1910 Pearl et al.
1,330,365 A 2/1920 Alexander
1,773,553 A 8/1930 Taylor et al.
2,108,063 A 2/1938 Hothersall
D110,872 S 8/1938 Lewis
2,177,589 A 10/1939 Jacker
2,276,635 A 3/1942 Weber
2,388,738 A 11/1945 Gudheim
2,562,647 A 7/1951 Shaver
2,576,416 A 11/1951 Randlett
2,690,861 A 10/1954 Tupper
2,894,654 A 7/1959 Löhrer
3,018,931 A 1/1962 Westgate
3,100,589 A 8/1963 Love, Jr.
3,113,693 A 12/1963 Stull
3,117,701 A 1/1964 Stull
3,140,019 A 7/1964 Barr
3,155,285 A 11/1964 Van Baarn
3,180,537 A 4/1965 Collins
3,203,571 A 8/1965 Plunkett
3,217,921 A 11/1965 Frehse
3,262,606 A 7/1966 Waterman
3,322,308 A 5/1967 Foster
3,323,671 A 6/1967 Minarik, Jr. et al.
3,372,832 A 3/1968 Yeater et al.
3,428,408 A 2/1969 Kosar
3,486,665 A 12/1969 La Croce
3,542,235 A 11/1970 Hidding
3,741,377 A 6/1973 Krellen
3,788,510 A 1/1974 Collins
3,888,373 A 6/1975 Gach et al.
D245,750 S 9/1977 Maclean
4,082,201 A 4/1978 Bittel
4,106,672 A 8/1978 Tecco et al.
4,120,432 A 10/1978 Fuchs
4,170,315 A 10/1979 Dubach et al.
D255,326 S 6/1980 Pettengill
4,253,587 A 3/1981 Otterson
4,274,563 A 6/1981 Otterson
4,280,636 A 7/1981 Lewis
4,284,200 A 8/1981 Bush et al.
4,291,818 A 9/1981 Nozawa et al.
4,346,823 A 8/1982 Eppenbach
D266,390 S 10/1982 Haner
4,359,171 A 11/1982 Lewis
4,361,250 A 11/1982 Foster
4,369,901 A 1/1983 Hidding
4,441,637 A * 4/1984 Libit ..... 222/556
4,463,869 A 8/1984 Lewis
4,494,679 A 1/1985 Cleevely
4,503,991 A 3/1985 Joyce
4,538,731 A 9/1985 Cillario
4,541,541 A * 9/1985 Hickman et al. ..... 220/253
4,545,495 A 10/1985 Kinsley
4,545,508 A 10/1985 Cribb, Jr. et al.
4,580,687 A * 4/1986 Lewis ..... 215/237
4,610,371 A 9/1986 Karkiewicz
4,611,725 A 9/1986 Kacalieff
4,621,744 A 11/1986 Foster
4,648,528 A 3/1987 LaBarge et al.
4,651,885 A 3/1987 Gach
4,658,980 A 4/1987 Lindstrom
4,693,399 A 9/1987 Hickman et al.
4,714,181 A 12/1987 Kozlowski et al.
4,723,693 A 2/1988 DeCoster
4,726,091 A 2/1988 Joyce
4,739,906 A 4/1988 LoTurco
4,792,054 A 12/1988 Weidman
4,793,501 A 12/1988 Beck
4,793,502 A 12/1988 Beck
4,801,054 A * 1/1989 Nycz ..... 222/545
4,823,995 A 4/1989 Lewis
4,848,612 A 7/1989 Beck
4,878,589 A 11/1989 Webster et al.
4,881,668 A 11/1989 Kitterman et al.
D305,206 S 12/1989 Hickman et al.
4,898,292 A 2/1990 VerWeyst et al.
D306,563 S 3/1990 Johnson
D306,701 S 3/1990 Beck
4,927,065 A 5/1990 Beck
4,936,494 A 6/1990 Weidman
4,940,167 A 7/1990 Fillmore et al.
4,955,504 A 9/1990 Lesscher
4,955,513 A 9/1990 Bennett
4,967,941 A 11/1990 Beck
4,971,213 A 11/1990 Ishinabe et al.
4,984,716 A 1/1991 Beck
4,993,606 A 2/1991 Bolen, Jr. et al.
5,007,555 A 4/1991 Beck
5,016,787 A 5/1991 Beck
D318,778 S 8/1991 Fiore et al.
D319,588 S 9/1991 Beck
5,048,730 A * 9/1991 Forsyth et al. ..... 222/482
D320,739 S 10/1991 Camus
5,052,572 A 10/1991 Pherigo
5,054,663 A * 10/1991 Groya et al. ..... 222/531
D321,476 S 11/1991 Alcover
D323,461 S 1/1992 Beck
D323,462 S 1/1992 Beck
5,083,671 A 1/1992 Hayes
D324,175 S 2/1992 Beck
5,085,331 A 2/1992 Groya et al.
5,129,531 A 7/1992 Beck et al.
5,129,533 A 7/1992 Loffler
5,167,338 A 12/1992 Kick
5,197,634 A 3/1993 Beck
5,211,301 A 5/1993 Groya et al.
5,215,204 A 6/1993 Beck et al.
5,219,100 A 6/1993 Beck et al.
D339,065 S 9/1993 Forsyth et al.
D340,187 S 10/1993 Forsyth
5,282,540 A 2/1994 Beck
5,297,688 A 3/1994 Beck et al.
5,305,931 A 4/1994 Martin et al.
D346,958 S 5/1994 Olson
D347,974 S 6/1994 McBride
5,328,063 A 7/1994 Beck et al.
5,330,082 A 7/1994 Forsyth
5,339,993 A 8/1994 Groya et al.
5,356,017 A 10/1994 Rohr et al.
5,392,938 A * 2/1995 Dubach ..... 215/254
5,395,015 A * 3/1995 Bolen et al. ..... 222/546
5,467,879 A 11/1995 Moore
5,494,200 A 2/1996 Sheffler et al.
5,499,736 A 3/1996 Kohl
5,507,419 A 4/1996 Martin et al.
5,509,582 A 4/1996 Robbins, III
5,511,679 A 4/1996 Beck
5,542,579 A 8/1996 Robbins, III
5,566,850 A 10/1996 Forsyth et al.
5,601,213 A 2/1997 Daniello
5,667,089 A 9/1997 Moore
5,680,968 A 10/1997 Moore
D385,791 S 11/1997 Forsyth et al.
5,743,444 A 4/1998 Beck et al.
5,799,838 A 9/1998 Miller
5,829,609 A 11/1998 Beck
5,829,611 A 11/1998 Beck
5,842,592 A 12/1998 Beck 5,875,907 A 3/1999 Lay
5,971,231 A 10/1999 Samz et al.
5,975,368 A 11/1999 Wood
5,996,859 A 12/1999 Beck
D419,069 S 1/2000 Beck et al.
6,024,256 A 2/2000 Beck et al.
6,102,257 A 8/2000 Goyet
6,158,632 A 12/2000 Ekkert
6,164,503 A 12/2000 Forsyth et al.
6,170,664 B1 1/2001 Dar
6,202,872 B1 3/2001 Smeyak et al.
D440,156 S 4/2001 Lonczak et al.
6,250,517 B1 * 6/2001 Samz et al. ..... 222/565
6,283,317 B1 9/2001 Benoît-gonin et al.
6,283,333 B1 * 9/2001 Knickerbocker et al. ..... 222/153.14
6,289,906 B1 9/2001 Vanden Dries et al.
6,299,033 B1 10/2001 VerWeyst et al.
6,308,870 B2 10/2001 Samz et al.
6,321,923 B1 11/2001 Wood
6,325,231 B1 12/2001 Ketting et al.
6,332,551 B1 12/2001 Copeland
RE37,634 E * 4/2002 Hickman et al. ..... 222/480
6,382,476 B1 5/2002 Randall et al.
6,405,885 B1 6/2002 Elliott
6,439,410 B1 8/2002 Dubach
6,460,712 B2 10/2002 Smith et al.
6,460,718 B1 * 10/2002 Vogel ..... 220/254.2
6,460,726 B1 10/2002 Hierzer et al.
6,464,113 B1 10/2002 Vogel
6,474,491 B1 11/2002 Benoit-Gonin et al.
6,477,743 B1 11/2002 Gross et al.
6,481,589 B2 11/2002 Blomdahl et al.
6,488,187 B2 12/2002 Sheffler et al.
6,494,346 B2 12/2002 Gross et al.
6,508,373 B1 1/2003 Robinson
6,510,971 B1 1/2003 Martin

* cited by examiner

CLOSURE FOR A CONTAINER

CROSS REFERENCE TO RELATED APPLICATIONS

The following patents are hereby incorporated by reference: U.S. Pat. No. 6,308,870 titled "Apparatus for Covering a Container" issued Oct. 30, 2001; U.S. Pat. No. 6,250,517 titled "Integrally-Formed Container" issued Jun. 26, 2001; and U.S. Pat. No. 5,971,231 titled "Integrally Formed Container" issued Oct. 26, 1999.

FIELD OF THE INVENTION

The present invention relates to a closure for a container for storing and dispensing particulate matter. The present invention more specifically relates to a closure for hand-held plastic containers with a cover having a plurality of flaps for enclosing, respectively, a plurality of openings in the cover. More specifically, it relates to a closure having improved retention features for maintaining the flaps in a closed position.

BACKGROUND OF THE INVENTION

It is generally known to provide hand-held plastic containers for storing and dispensing particulate matter, particularly foodstuffs or seasonings such as those displayed and sold in supermarkets. Such known containers typically have several openings, particularly a plurality of shaker openings on one side of the container and a single spooning opening on an opposite side of the closure. The known closures generally include a hinged flap for the shaker and for the spooning openings configured to close or seal these openings when the container is not in use.

Such known closures typically include a latching device on the flaps or on the closure body for maintaining the flaps in a closed position when dispensing of the container contents is not required. Such latching devices may include projections or downwardly extending skirts extending from an underside of the flap and configured to engage the opening in an interference-type fit to retain the flap in a closed position. While, such known latching devices may be generally sufficient to maintain the flaps closed under static conditions, these latching devices frequently provide insufficient retention force to maintain the flaps in a closed position during dynamic installation conditions. During installation of the closure on the container by automated equipment, the closure may typically be pressed-on over a circumferential rib, or the closure may be spun-on and tightened to the container via a threaded interface. The torque typically applied to the closure often results in sufficient distortion of the closure body to cause the flap latches to release, allowing the flaps to open on the assembly line. Such release of the flaps during the automated closure process results in the additional time and expense required to manually re-close the closure flaps prior to shipment of the containers.

Accordingly, it would be advantageous to provide a container closure having a more robust design that is more capable of maintaining the flaps in a closed position during automated assembly processes. It would also be advantageous to provide a container closure flap latching device that did not require substantial additional force by a user to open the flaps. It would be further advantageous to provide closure flaps that are biased toward a closed position. It would be further advantageous to provide a container closure flap latching device that does not add substantial complexity or additional forming operations to the closure molding and manufacturing process.

Accordingly, it would be advantageous to provide a closure of the type disclosed in the present application that includes any one or more of these or other advantageous features.

SUMMARY OF THE INVENTION

The present invention relates to an integrally-formed cover for a container comprising a cylindrical portion, a top portion having a plurality of shaker openings and a spooning opening, a shaker flap, and a spooning flap. The shaker flap has an outer edge with a downwardly extending skirt, is coupled to the top portion, and is configured for selective movement between an open position in which the shaker openings are opened and a closed position in which the shaker openings are covered by the shaker flap. The spooning flap has an outer edge with a downwardly extending skirt, is coupled to the top portion, and is configured for selective movement between an open position in which the spooning opening is opened and a closed position in which the spooning opening is covered by the spooning flap. At least one projection extends from the spooning flap to releasably retain the spooning flap in the closed position. The projection extending from the spooning flap includes a tab. A guide is provided with the tab so that movement of the spooning flap from the open position to the closed position initially brings the guide into wedging interaction with the inner edge of the spooning opening, and further movement of the spooning flap brings the tab into wedging interaction with the inner edge of the spooning opening. The spooning flap is retained in the closed position by the wedging interaction of the tab against the inner edge of the spooning opening.

DETAILED DESCRIPTION OF THE PREFERRED EMBODIMENTS

Figure 1A:
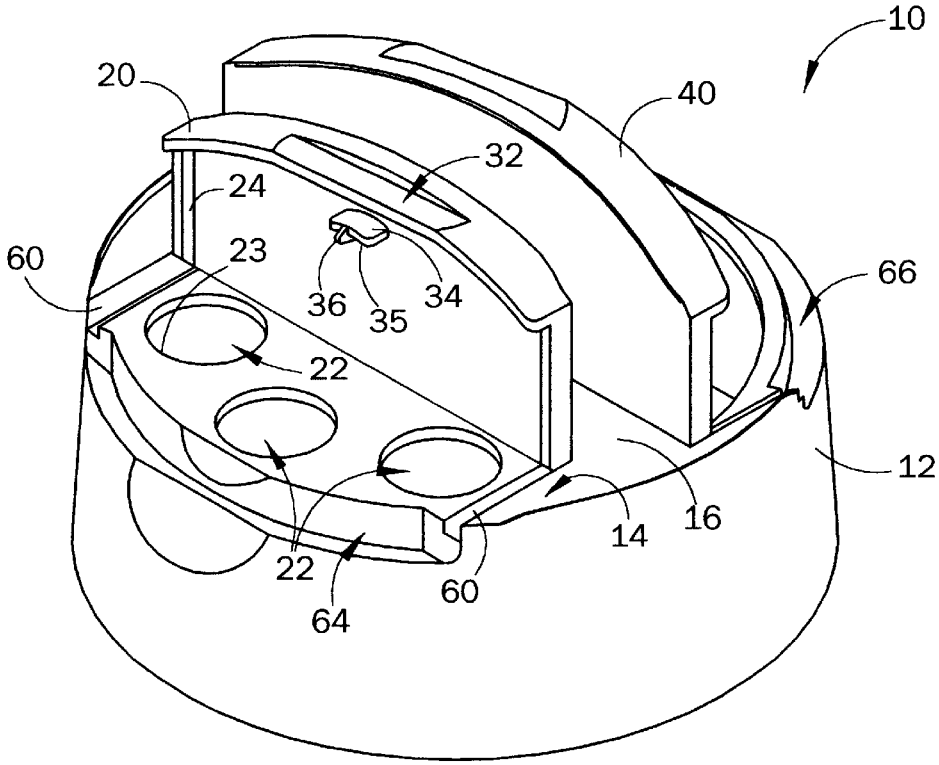
FIG. 1A is a perspective view of a shaker side of a closure for a container according to a preferred embodiment.
Figure 1B:
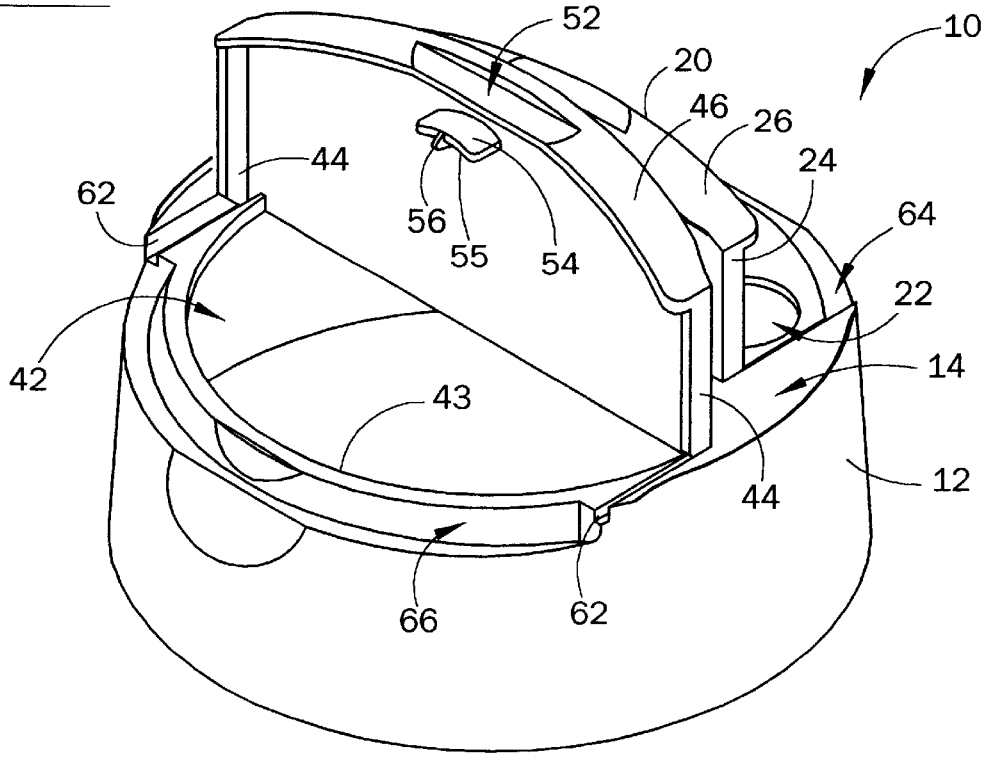
FIG. 1B is a perspective view of a spooning side of a closure for a container according to a preferred embodiment.

Referring to FIGS. 1A and 1B, a closure 10 for a container (not shown) is provided according to a preferred embodiment. Closure 10 includes a shaker flap 20, which covers (when closed) shaker openings 22 located in a top portion 14 of the closure 10. Closurer 10 also includes a spooning flap 40 that similarly covers a larger spooning opening 42 located generally opposite from shaker openings 22 on top portion 14. Spooning flap 40 and shaker flap 20 are separated on top portion 14 by a web 16. Closure 10 is preferably adapted for use with a container having a cylindrical shape of the type used for dispensing powdered or granulated material and having an opening diameter in the range of twenty (20) through one-hundred forty (140) millimeters. However, in alternative embodiments, the closure may have any shape suitable for use with other types or sizes of containers and materials to be dispensed.

Figure 4A:
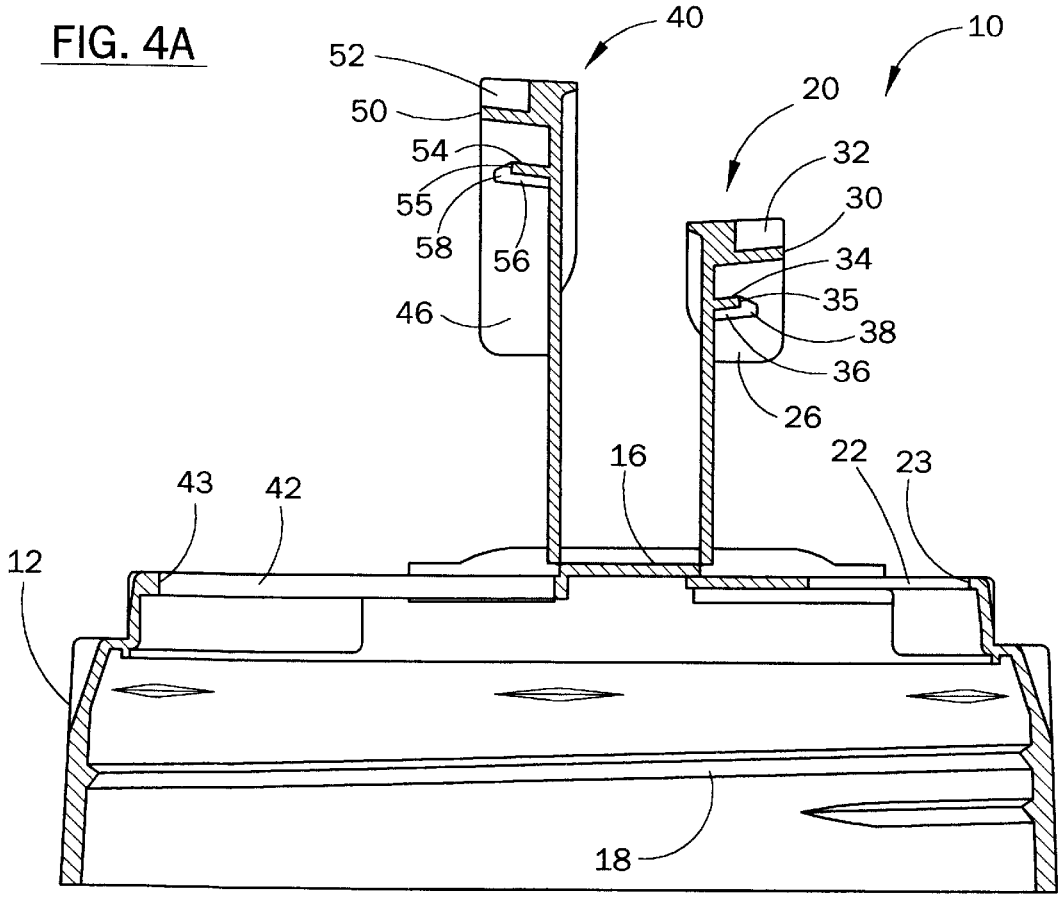
FIG. 4A is a cross sectional view along line 4A—4A of FIG. 3A of a closure for a container with a spooning flap and a shaker flap in an open position according to a preferred embodiment.

Closure 10 is in the form of a substantially cylindrical portion 12 with top portion 14 coupled to, and generally enclosing, an upper end of cylindrical portion 12. Alternatively, cylindrical portion 12 may be frustoconical in shape. Top portion 14 is preferably be formed having a concave surface with the lowest portion located in a central region of top portion 14 (as shown schematically in FIG. 2C), however the top portion 14 may be substantially flat in alternative embodiments. Referring to FIG. 4A, threads 18 are provided on the inner surface of cylindrical portion 12 for coupling cylindrical portion 12 to the outside of the top of a dispensing receptacle or container having conventional mating threads (not shown). Alternatively, cylindrical portion 12 may be equipped with an inner detent or a raised ring to allow it to be "snap" connected to a container or receptacle.

Referring to FIG. 1A, closure 10 includes elongate recesses 60 in which a wall portion (shown schematically as shaker side skirts 24) on either side of shaker flap 20 will fit when shaker flap 20 is in a closed position. Closure 10 also includes similar elongate recesses 62 in which a wall portion (shown schematically as spooning side skirts 44) on either side of spooning flap 40 will fit when spooning flap 40 is in the closed position. The fit of the side skirts in the elongated recesses provides a substantially continuous upper surface on top portion 14, upon which a corresponding bottom portion of a similar container can be stacked (not shown).

Figure 2A:
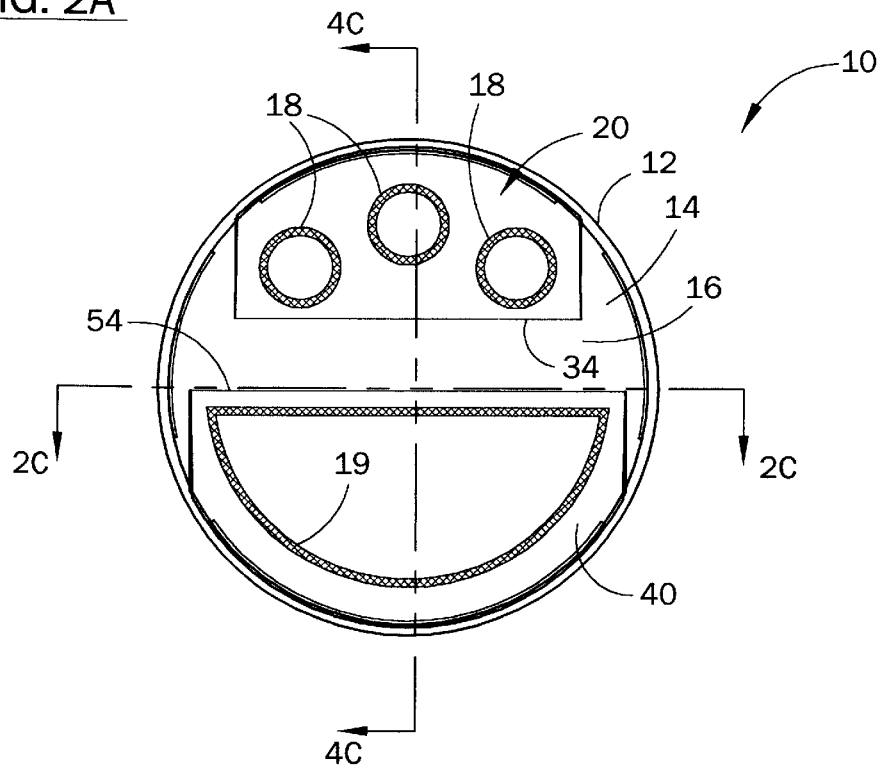
FIG. 2A is a top view of a closure for a container according to a preferred embodiment.
Figure 2B:
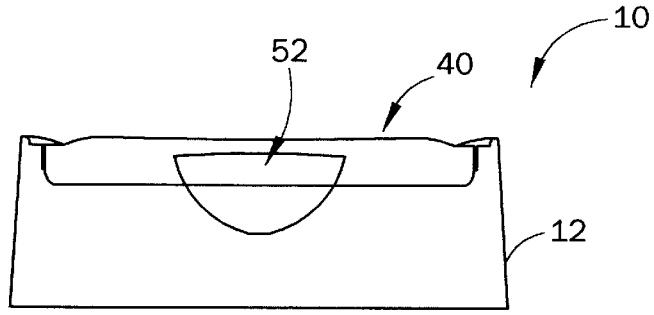
FIG. 2B is a front view of a closure for a container according to a preferred embodiment.
Figure 3A:
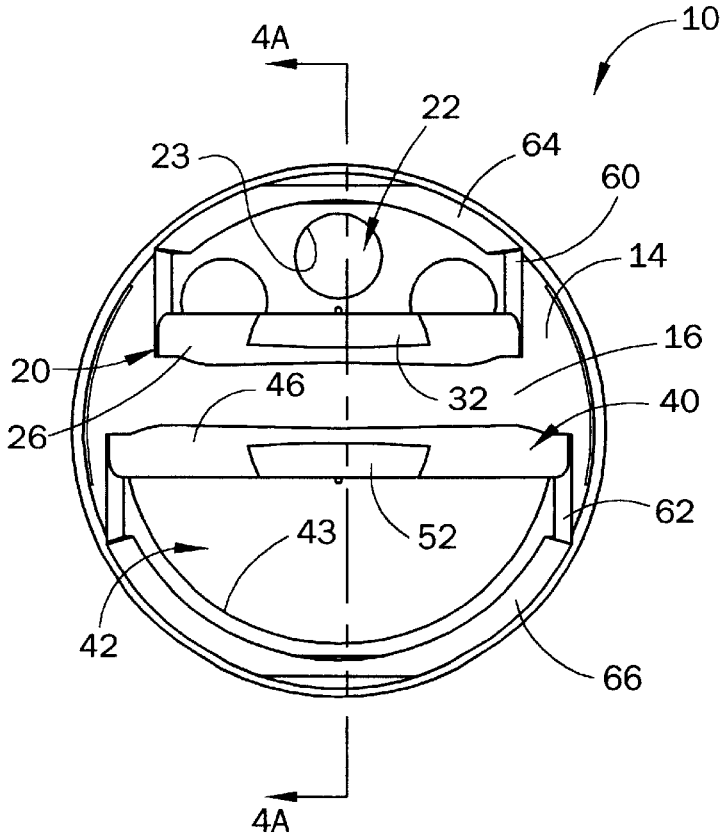
FIG. 3A is a top view of a closure for a container having a shaker flap and a spooning flap in an open position according to a preferred embodiment.
Figure 5A:
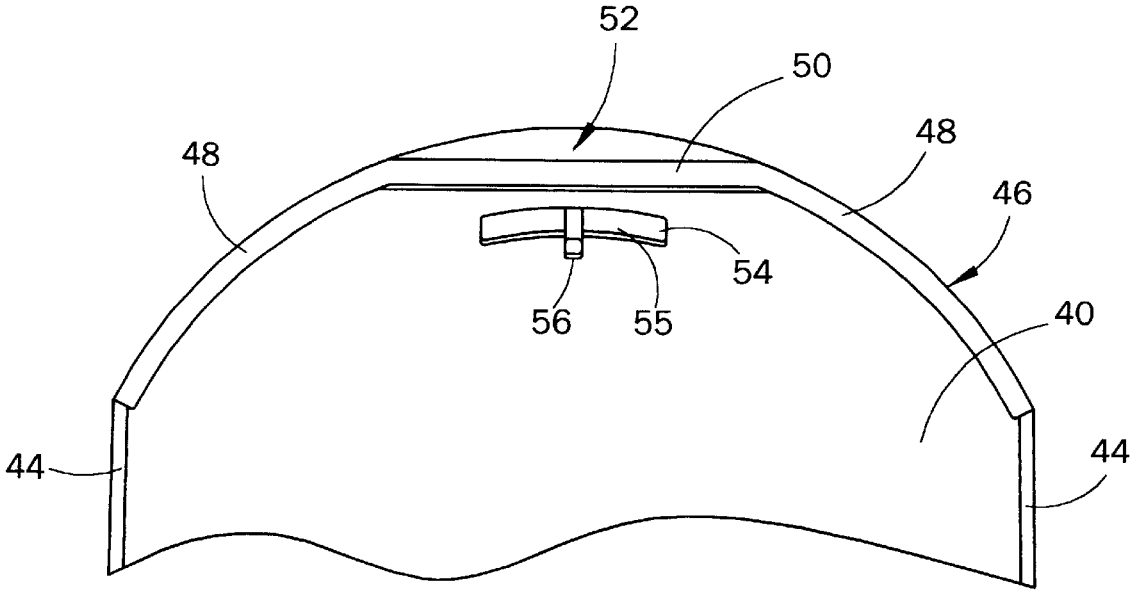
FIG. 5A is an elevation view of a spooning flap in an open position for a closure for a container according to a preferred embodiment.
Figure 5B:
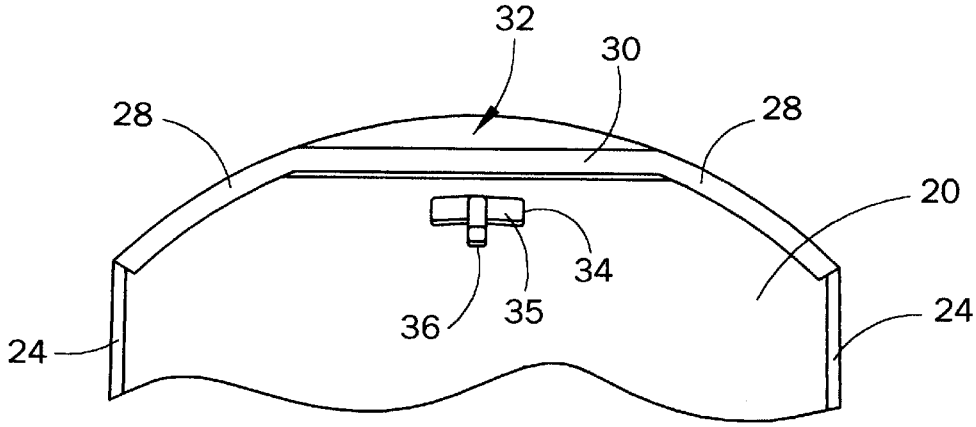
FIG. 5B is an elevation view of a shaker flap in an open position for a closure for a container according to a preferred embodiment.

Referring further to FIGS. 1A, 2B and 3A, shaker flap 20 includes a projection (shown schematically as a downwardly extending front skirt 26) depending from a lower surface of spooning flap 20 that includes an arcuate portion 28 and a substantially straight portion 30 (shown schematically in FIG. 5B). Front skirt 26 extends from shaker flap 20 near an outer edge of shaker flap 20 to define an outer substantially vertical surface of closure 10 when shaker flap 20 is in a closed position. Front skirt 26 has an indentation 32 at a central outer portion of skirt 26 at straight portion 30, which may facilitate opening of the flap by a user. Front skirt 26 preferably extends around closure 10 for an angle of between approximately sixty (60) and one-hundred twenty (120) degrees. Therefore, front skirt 26 forms between sixty (60) and one-hundred twenty (120) degrees of the circumference of the upper part of closure 10. Front skirt 26 is generally arcuate (rather than uniformly straight) and may be less likely to be bent over when the flap is grasped and opened, and further distributes the grasping load more evenly around the outer edge of shaker flap 20. Accordingly, shaker flap 20 may be made using less plastic when manufactured. Shaker flap 20 is coupled to top portion 14 by a flexible and integrally formed hinge 34 defined by a groove preferably extending along a straight line for substantially the entire length of shaker flap 20. Spooning flap 40 is coupled to top portion 14 by a flexible and integrally formed hinge 54 preferably extending along a straight line for substantially the entire length of spooning flap 40. Hinges 34 and 54 are disposed adjacent to web 16 of top portion 14.

Figure 2C:
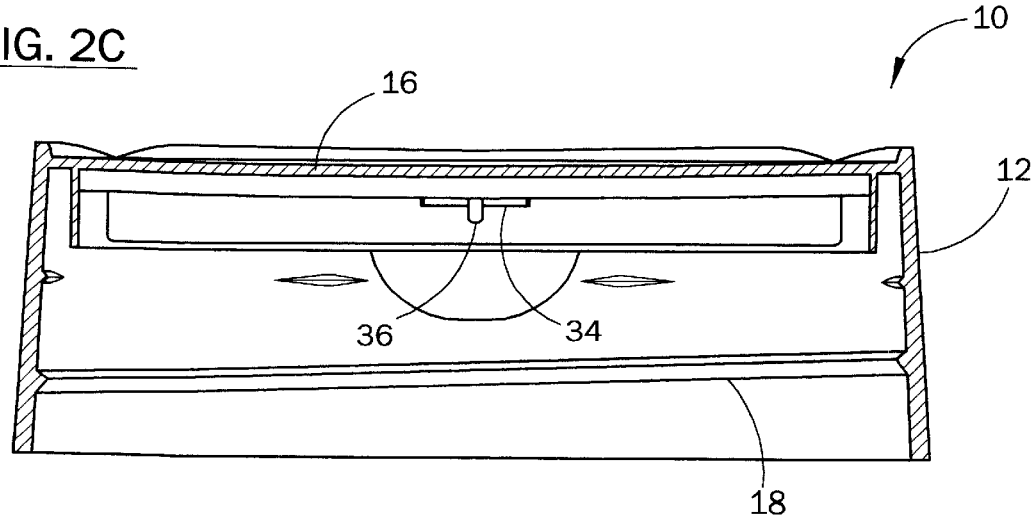
FIG. 2C is a cross sectional view of the closure for a container of FIG. 2A according to a preferred embodiment.

Referring to FIG. 2C, the concave shape of top portion 14 provides a slight inward bow in web 16 and hinges 34 and 54 have an inwardly arcuate or bowed profile according to a preferred embodiment. The arcuate profile of web 16 and hinges 34 and 54 provides a biasing force tending close the shaker flap 20 and spooning flap 40. As shaker flap 20 and spooning flap 40 are moved to an open position, the straight edge of flaps 20 and 40 along hinges 34 and 54 tends to flex the bowed web 16 of concave top portion 14 into a flatter profile. The biasing force created by top portion 14 and web 16 in the flexed condition tends to move flaps 20 and 40 toward their closed position. According to alternative embodiments, the top portion may be made substantially flat so that a biasing force is not created when the flaps are opened.

Figure 3B:
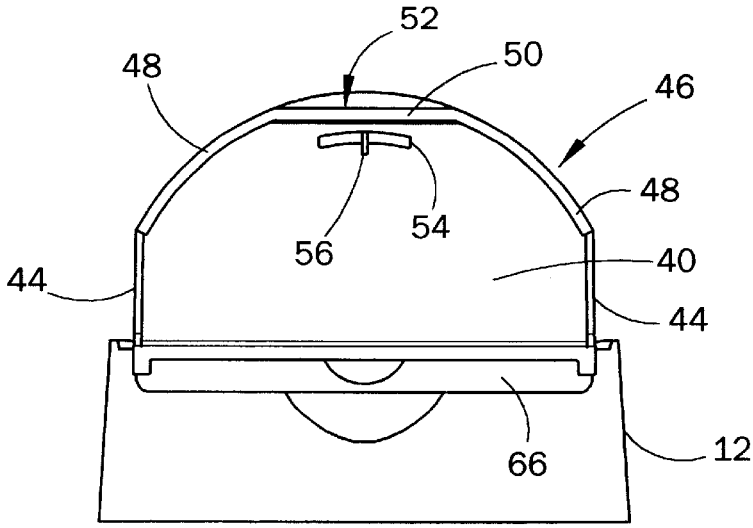
FIG. 3B is a front view of a closure for a container having with a spooning flap in an open position according to a preferred embodiment.

Spooning flap 40 similarly encloses spooning opening 42. According to a preferred embodiment, spooning flap 40 has a projection (shown schematically as a downwardly extending front skirt 46) depending from a lower surface of spooning flap 40 that includes an arcuate portion 48 and a substantially straight portion 50 (as shown schematically in FIGS. 3B and 5A). Arcuate portion 48 preferably extends through an arc having an angle of between approximately one-hundred twenty (120) and one-hundred eighty (180) degrees to provide a sufficiently large spooning opening and defines an outer substantially vertical surface of closure 10 when spooning flap 40 is in a closed position. Front skirt 46 has an indentation 52 disposed at a central outer portion of front skirt 46 coincident with straight portion 50, which may facilitate the opening of the flap by a user. Front skirt 46 preferably extends around closure 10 when in the closed position for an angle of between approximately one-hundred (100) and one-hundred fifty (150) degrees. Front skirt 46 forms between one-hundred (100) and one-hundred fifty (150) degrees of the circumference of the upper part of closure 10. As with front skirt 26 of shaker flap 20, since front skirt 46 is generally arcuate (rather than uniformly straight) it has greater structural strength and it is less likely to be bent over when its flap is grasped and opened, and further distributes the grasping load more evenly around the outer edge of spooning flap 40. Accordingly, spooning flap 40 may require less plastic when manufactured.

Referring further to FIGS. 1A and 1B. a recess 64 is provided in the cylindrical portion 12 of closure 10 to receive front skirt 26 of shaker flap 20, according to a preferred embodiment. By providing recess 64, front skirt 26 can be set into an outer surface of closure 10 when shaker flap 20 is closed, thereby reducing the risk that front skirt 26 will be inadvertently caught and shaker flap 20 opened and the contents of the container spilled. Similarly, a recess 66 is provided in closure 10 on the opposite side of closure 10 from recess 64 to similarly receive front skirt 46 of spooning flap 40 for the same reason. The recess of front skirts 26 and 46 provides a smooth and contiguous part of the cylindrical portion 12 of closure 10.

Figure 4B:
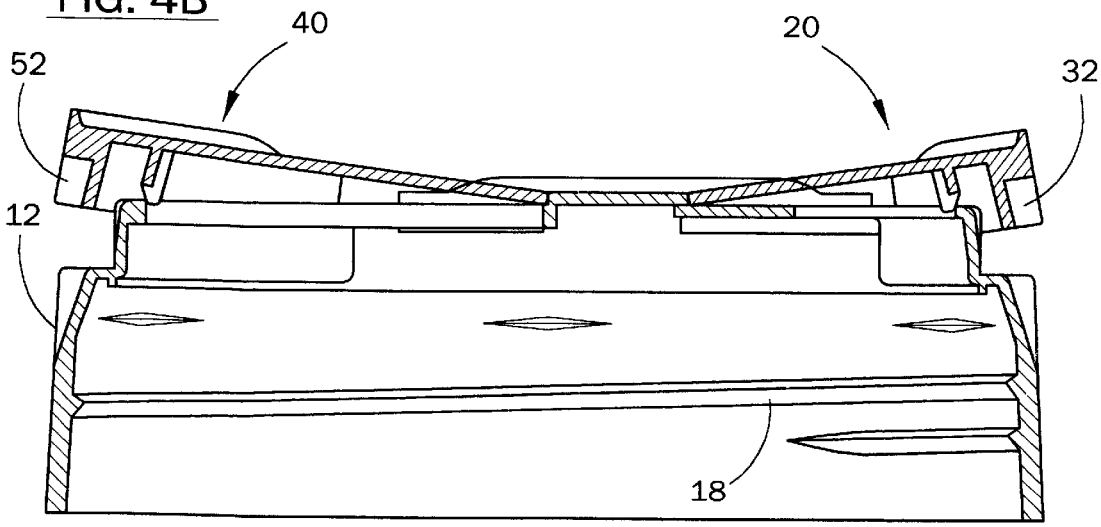
FIG. 4B is a cross sectional view of the closure for a container of FIG. 4A with a spooning flap and a shaker flap approaching a closed position according to a preferred embodiment.
Figure 4C:
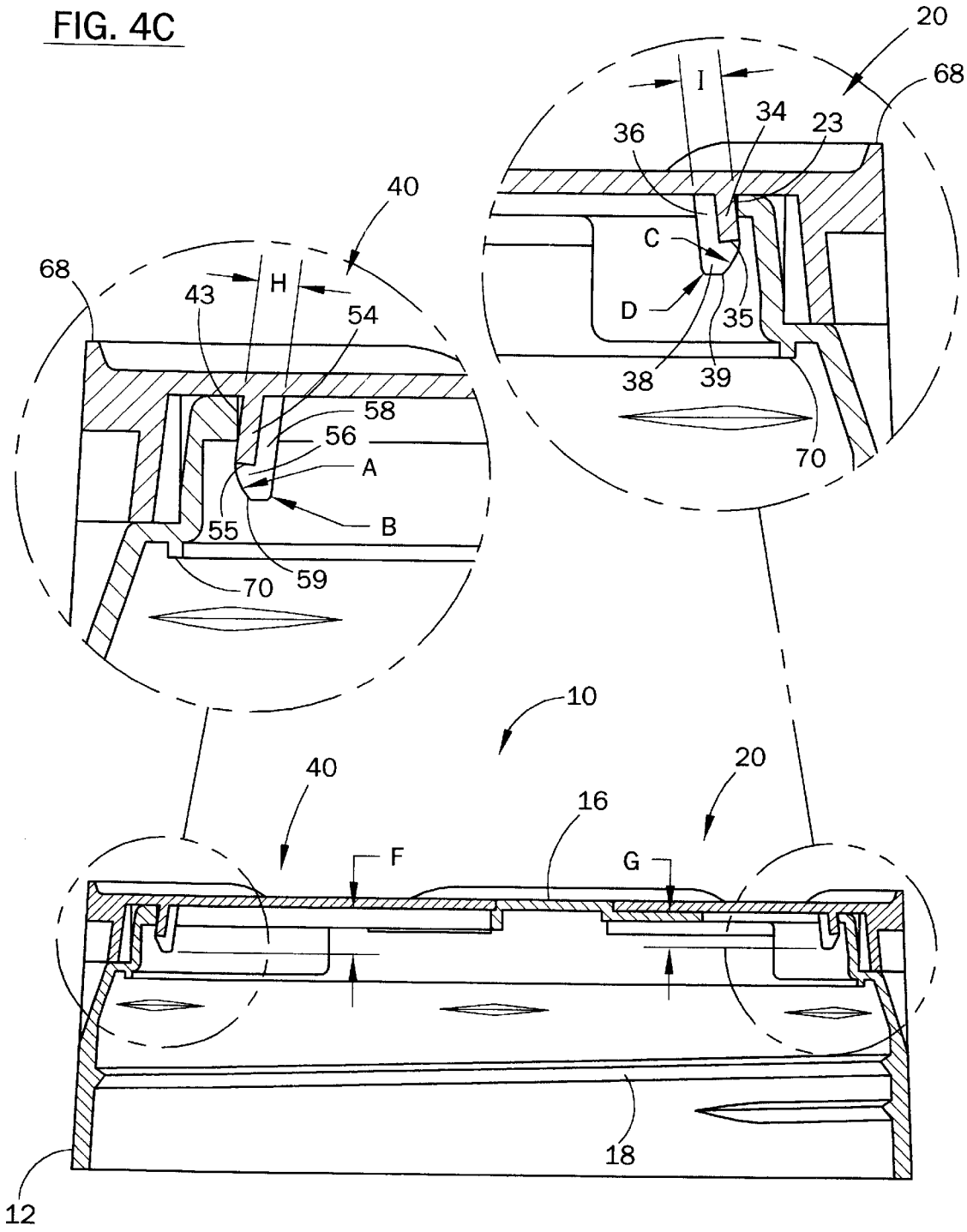
FIG. 4C is a cross sectional view along line 4C—4C of FIG. 2A of a closure for a container with a spooning flap and a shaker flap in a closed position according to a preferred embodiment.

Referring to FIGS. 4A–4C, a rim (shown schematically as a lip 68, or trim portion, etc.) is provided to facilitate the arrangement of multiple containers in a stacked relationship. Lip 68 extends substantially around the perimeter of top portion 14 but may have interruptions at suitable locations for improving aesthetics or flap operability. As shown in FIG. 4C, lip 68 is formed with a cross section in the shape of an upwardly projecting, truncated right triangle, but may be formed having an inwardly concave or wedge-shaped profile for improved molding releasability in alternative embodiments. According to a preferred embodiment, an underside of top portion 14 has an annular sealing rim, mouth or land 70 projecting downwardly and extending continuously adjacent an inner perimeter of cylindrical portion 12. Land 70 is laterally positioned to facilitate an abutting relationship with the mouth of a corresponding container (not shown).

Referring to FIG. 1A, a plurality of shaker openings 22 (shown schematically as circular apertures, but may have any suitable shape for dispensing material in a container) are provided to allow the contents within the container to be dispensed when shaker flap 20 is opened. In a preferred embodiment, these openings are arranged along an arc, but may be arranged in other patterns (e.g. straight line, matrix array, circular, etc.) suitable for dispensing the contents in a shaking operation in alternative embodiments.

Referring to FIGS. 1A and 4C, the closure 10 is shown with an interface for retaining, securing or latching the shaker flap according to a preferred embodiment. One or more interfaces such as projections, retainers, latches, extensions or skirts (shown schematically as downwardly latching tabs 34) are provided on an underside of shaker flap 20. Tabs 34 preferably have an arcuate shape that corresponds to the arcuate shape of shaker aperture 22 and extends from the underside of shaker flap 20 at an angle of between approximately nine (9) and twenty-five (25) degrees with respect to top portion 14. In a particularly preferred embodiment, tabs 34 extend from an underside of shaker flap 20 at an angle of between approximately fifteen (15) and twenty (20) degrees, with respect to top portion 14. The closure 10, including the flaps 20, tabs 34 and member 36 may be integrally molded as a single piece. In alternative embodiments, other angles of formation may be used and the closure may be made in one or several molding operations. In further alternative embodiments, the interfaces may have (in plan view) a non-arcuate or straight profile for engaging a corresponding straight segment on the edge (not shown).

Referring to FIGS. 4A–4C, the tabs 34 are shown according to a preferred embodiment. Tabs 34 are located or positioned on the shaker flap with an upper front surface of tab 34 approaching, but not extending beyond, edge 23. A lower leading edge 35 of tab 34 extends beyond edge 23 of shaker opening 22 such that when shaker flap 20 approaches the closed position, the leading edge 35 of tab 34 extends beyond edge 23 in a manner that would not otherwise allow tab 34 to enter shaker opening 22 and without wedging into edge 23 to permit shaker flap 20 to close.

Referring further to FIGS. 1A and 4C, the interface (shown schematically as tab 34) may include a member such as a reinforcing member, stiffener, rigidifier, brace, rib, etc. (shown schematically as guide 36). In a particularly preferred embodiment, guide 36 is oriented substantially perpendicular to tab 34 in a "T-shaped" configuration that is integrally formed with tab 34 and flap 20, and has a outward surface generally coincident to the outward surface of tab 34. However, the member may be separate from the interface or reconfigured in relation to the interface in alternative embodiments. As shown in FIG. 4C, guide 36 includes a guide surface shown schematically as lower portion 38 extending downwardly beyond leading edge 35 of tab 34, and having an outer curved face (shown schematically as cam 39). In a particularly preferred embodiment, the surface of cam 39 is defined by multiple radii to create a wedging interaction with edge 23 as shaker flap 20 is moved into the closed position. However, a single radius may be used in alternative embodiments.

In a preferred embodiment, as shaker flap 20 is moved to the closed position, cam 39 contacts the inside of edge 23 before leading edge 35 of tab 34 reaches top portion 14, and tab 34 passes through shaker opening 22 and becomes wedged against edge 23 of shaker opening 22 when shaker flap 20 is moved into the closed position. As the shaker flap 20 is moved into the closed position, cam 39 of lower portion 38 disengages from edge 23, as tab 34 remains engaged with (remains wedged against) edge 23. The increasing force necessary to permit flap closure may be accommodated by deflection or flexing of any one or more of the shaker flap 20, the shaker opening 22, the shaker hinge 32, the top portion 14, or the web 16. In a preferred embodiment, guide 36 stiffens or reinforces tab 34 when shaker flap 20 is in the closed position to provide additional resistance to flexing of tab 34.

In a particularly preferred embodiment, closure 10 is a seventy (70) millimeter closure and guide 36 is sized (shown schematically in FIG. 4C), having a depth dimension G of approximately 0.152 (0.142–0.162) inches and a width dimension I of approximately 0.118 (0.108–0.128) inches; however, other dimensions may be used as appropriate to provide a wedging action for improved retention during closure of the shaker flap. Cam 39 on guide portion 36 is preferably formed with a multi-radii surface (shown schematically in FIG. 4C) with a first radius C of approximately 0.100 (0.090–0.110) inches and a second radius D of approximately 0.040 (0.030–0.050) inches; however, other dimensions may be used as appropriate to accommodate closures for other size containers and to provide a cam operation and wedging action for improved retention during closure of the shaker flap. According to alternative embodiments, a cam portion may be formed on the interface without a member.

Figure 6A:
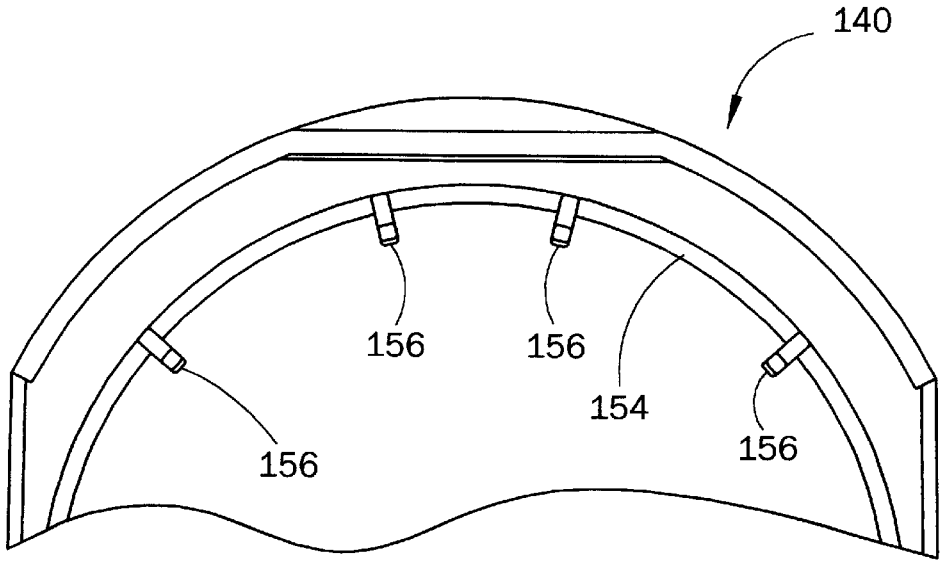
FIG. 6A is an elevation view of a spooning flap in an open position for a closure for a container according to an alternative embodiment.
Figure 6B:
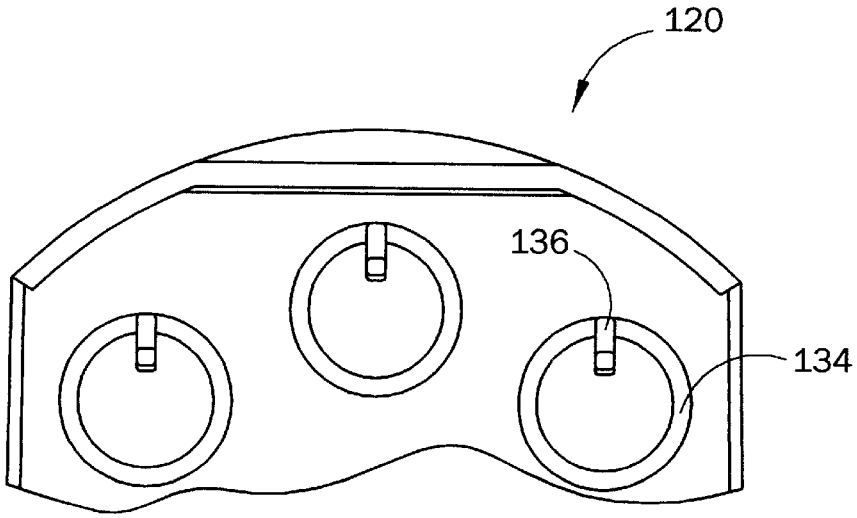
FIG. 6B is an elevation view of a shaker flap in an open position for a closure for a container according to an alternative embodiment.

Referring to FIG. 6B, an interface for latching a shaker flap is shown according to an alternative embodiment. Shaker flap 120 includes one or more shaker opening seals in the form of skirts or projections (shown schematically as downwardly extending circular tabs 134) from an underside of the shaker flap and having a profile (in plan view) corresponding (to the shape of the shaker opening 22. Tabs 134 extend downward at an angle and include one or more members (shown schematically as guides 136) having the features shown in FIGS. 4A–4C as previously described.

Figure 7A:
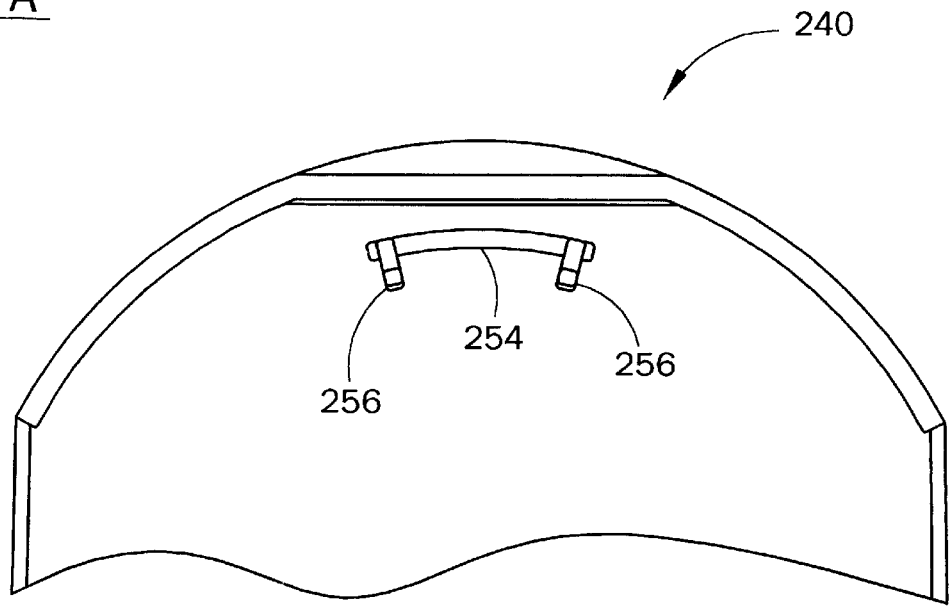
FIG. 7A is an elevation view of a spooning flap in an open position for a closure for a container according to an alternative embodiment.
Figure 7B:
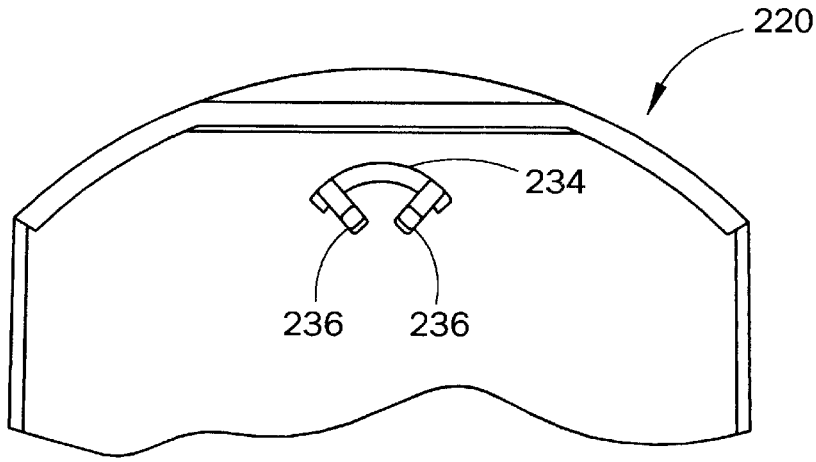
FIG. 7B is an elevation view of a shaker flap in an open position for a closure for a container according to an alternative embodiment.

Referring to FIG. 7B, an interface for latching a shaker flap is shown according to another alternative embodiment. Shaker flap 220 may include one or more projections (shown schematically as downwardly extending arcuate tabs 234) having a profile corresponding to the shape of a circular shaker opening 22. Tabs 234 extend at an angle and include two or more members (shown schematically as guides 236) having the features shown in FIGS. 4A–4C as previously described.

Referring to FIG. 2A, indicators for shaker flap 20 are shown according to an exemplary embodiment. Indicators 18 are formed or otherwise provided on an upper side of shaker flap 20 corresponding to the pattern of shaker openings 22 and permit identification of the shaker pattern without opening the shaker flap.

Referring to FIG. 1B, a spooning opening 42 (shown schematically as a truncated circular opening) is shown according to a preferred embodiment. Spooning opening 42 allows the contents within the container to be dispensed when spooning flap 40 is opened. One or more ±5 interfaces such as latches, retainers, projections, extensions or skirts (shown schematically as downwardly projecting tabs 54) are provided on an underside of spooning flap 40. As shown schematically in FIGS. 1B and 4C, tabs 54 have an arcuate shape that corresponds to the shape of spooning opening 42 and extend at an angle from the underside of spooning flap 40 of between approximately nine (9) and twenty-five (25) degrees with respect to top portion 14. In a particularly preferred embodiment, tabs 54 extend from an underside of spooning flap 40 at an angle of between approximately fifteen (15) and twenty (20) degrees, with respect to top portion 14. The closure 10, including the flap 40, tab 54 and guide 56 may be integrally molded as a single piece. In alternative embodiments, other angles of formation may be used and the closure may be made in one or several molding operations. In further alternative embodiments, the interfaces may have (in plan view) a non-arcuate or straight profile for engaging a corresponding straight segment on the edge (not shown).

Referring to FIGS. 4A–4C, tabs 54 are shown according to a preferred embodiment. Tabs 54 are located or positioned on the spooning flap with an upper front surface of tab 54 approaching, but not extending beyond, edge 43. A lower leading edge 55 of tab 54 extends beyond edge 43 such that when spooning flap 40 approaches the closed position, the leading edge 55 of tab 54 extends beyond edge 43 in a manner that would not otherwise allow tab 54 to enter spooning opening 42 without wedging into edge 43 to permit spooning flap 40 to close.

Referring further to FIGS. 1B and 4C, the interface (shown schematically as tab 54) may include a member such as a reinforcing member, stiffener, rigidifier, brace, rib, etc. (shown schematically as guide 56). In a particularly preferred embodiment, guide 56 is oriented substantially perpendicular to tab 54, in a "T-shaped" configuration that is integrally formed with tab 54 and flap 40, and has a outward surface generally coincident to the outward surface of tab 54. However, the member may be separate from the interface or reconfigured in relation to the interface in alternative embodiments. As shown in FIG. 4C, guide 56 includes a guide surface shown schematically as lower portion 58 extending downwardly beyond leading edge 55 of tab 54, and having an outer curved face (shown schematically as cam 59). In a particularly preferred embodiment, the surface of cam 59 is defined by multiple radii to create a wedging interaction with edge 43 as spooning flap 40 is moved into the closed position. However, a single radius may be used in alternative embodiments.

In a preferred embodiment, as spooning flap 40 is moved to the closed position, cam 59 contacts the inside of edge 43 before leading edge 55 of tab 54 reaches top portion 14, and tab 54 passes through spooning opening 42 and becomes wedged against edge 43 of spooning opening 42 when spooning flap 40 is moved into the closed position. As spooning flap 40 is moved into the closed position, cam 59 of lower portion 58 disengages from edge 43, while tab 54 remains engaged with (remains wedged against) edge 43. The increasing force necessary to permit flap closure may be resiliently accommodated by deflection or flexing of any one or more of the spooning flap 40, the spooning opening 42, the spooning hinge 54, the top portion 14, and the web 16. In a preferred embodiment, guide 56 stiffens or reinforces tab 54 when spooning flap 40 is in the closed position to provide additional resistance to flexing of tab 54.

In a particularly preferred embodiment, closure 10 is a seventy (70) millimeter closure and guide 56 is sized (shown schematically in FIG. 4C), having a depth dimension F of approximately 0.180 (0.170–0.190) inches and a width dimension H of approximately 0.115 (0.105–0.125) inches; however, other dimensions may be used as appropriate to provide a wedging action for improved retention during closure of the spooning flap. Cam 59 on guide portion 56 is preferably formed with a multi-radii surface (shown schematically in FIG. 4C) with a first radius A of approximately 0.100 (0.090–0.110) inches and a second radius B of approximately 0.040 (0.030–0.050) inches; however, other dimensions may be used as appropriate to accommodate closures for other size containers and to provide a cam operation and wedging action for improved retention during closure of the spooning flap. According to alternative embodiments, a cam portion may be formed on the tab portion without a member.

Referring to FIG. 6A, an interface for latching a spooning flap is shown according to an alternative embodiment. Spooning flap 140 includes a spooning opening seal in the form of a skirt or projection (shown schematically as downwardly extending truncated circular tab 154) from an underside of spooning flap 140 and having a profile (in plan view) corresponding to the shape of spooning opening 42. Tab 154 extends at an angle and includes one or more members (shown schematically as guides 156) having the features shown in FIGS. 4A–4C as previously described.

Referring to FIG. 7A, an interface for latching a spooning flap is shown according to another alternative embodiment. Spooning flap 240 includes one or more projections (shown schematically as downwardly extending arcuate tab 254) having a profile corresponding to the arcuate shape of spooning opening 42. Tabs 254 extend at an angle and include two or more members (shown schematically as guides 256) having the features shown in FIGS. 4A–4C previously described.

Referring to FIG. 2A, indicators for spooning flap 40 are shown according to an exemplary embodiment. Indicator 19 is formed or otherwise provided on an upper side of spooning flap 40 to indicate the location of spooning opening 42 without opening spooning flap 40.

It is important to note that the construction and arrangement of the elements of the closure for a container provided herein are illustrative only. Although only a few exemplary embodiments of the present invention have been described in detail in this disclosure, those skilled in the art who review this disclosure will readily appreciate that many modifications are possible in these embodiments (such as variations in closure features such as orientation of flaps, skirts and corresponding recesses; variations in sizes, structures, shapes, dimensions and proportions of the tabs and stiffeners and other elements; flap hinge arrangements, configuration and operation of latching devices, arrangement of dispensing openings, use of materials, colors, combinations of shapes, etc.) without materially departing from the novel teachings and advantages of the invention. For example, the closure may be adapted and sized for use on any type of container or receptacle in a variety of sizes and for dispensing a variety of contents. According to other alternative embodiments, the closure may be adapted for installation to a container by a threaded interface or by a snap-on ring. Further, it is readily apparent that variations of the closure and its elements may be provided in a wide variety of shapes, sizes, and thicknesses. It is also readily apparent that the closure interfaces and members for latching the flaps may be designed with any profile and configuration suitable for securely latching the flaps to the closure body. For example, the latching tabs may be short arc portions with a member or members, or the interfaces may have an outline corresponding to the perimeter of the closure openings (not shown) with a member or multiple members, or other shapes useful for retaining the flaps securely to the closure body when the flaps are in a closed position.

The order or sequence of any process or method steps may be varied or resequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. In an integrally-formed cover for a container comprising a cylindrical portion, a top portion having a plurality of shaker openings and a spooning opening, a shaker flap having an outer edge with a downwardly extending skirt and coupled to the top portion and configured for selective movement between an open position in which the shaker openings are opened and a closed position in which the shaker openings are covered by the shaker flap, a spooning flap having an outer edge with a downwardly extending skirt and coupled to the top portion and configured for selective movement between an open position in which the spooning opening is opened and a closed position in which the spooning opening is covered by the spooning flap, at least one projection extending from the spooning flap to releasably retain the spooning flap in the closed position, the improvement comprising:

the projection extending from the spooning flap comprises a tab; and a guide provided with the tab so that movement of the spooning flap from the open position to the closed position initially brings the guide into wedging interaction with the inner edge of the spooning opening and further movement of the spooning flap brings the tab into wedging interaction with the inner edge of the spooning opening;

so that the spooning flap is retained in the closed position by the wedging interaction of the tab against the inner edge of the spooning opening.

2. The cover of claim 1 further comprising an upwardly projecting lip extending substantially around an outer portion of the top portion, the shaker flap and the spooning flap, whereby the lip provides a guide for positioning a container bottom stacked on top of the cover.

3. The cover of claim 1 wherein the guide is provided at the center of the tab.

4. The cover of claim 1 wherein the guide includes a curved portion extending beyond a free end of the tab.

5. The cover of claim 4 wherein the curved portion of the guide is configured to contact the inner edge of the spooning opening.

6. The cover of claim 5 wherein the curved portion of the guide is provided on the outer surface of the guide.

7. The cover of claim 6 wherein the curved portion of the guide comprises a cam portion.

8. The cover of claim 7 wherein the cam portion is defined by at least one radius.

9. The cover of claim 1 wherein the tab extends angularly downward from an underside of the spooning flap and at least partially through the spooning opening when the spooning flap is in the closed position.

10. The cover of claim 1 wherein the tab has a curved profile relative to a central axis of the cover concentric with a curved profile of the spooning opening relative to the central axis of the cover.

11. The cover of claim 1 further comprising a plurality of guides provided on the tab.

12. The cover of claim 1 wherein the guide and the tab at least partially share an outer surface.

13. The cover of claim 1 further comprising a reinforcing member coupled to the tab.

14. The cover of claim 1 further comprising a web biasing the spooning flap toward the closed position.

15. The cover of claim 14 wherein the web is bowed when the spooning flap is in the closed position.

16. The cover of claim 15 wherein the shaker flap and the spooning flap are integrally hinged to the web in a substantially parallel and adjacent configuration.

17. The cover of claim 1 further comprising one or more indicators on the spooning flap.

18. The cover of claim 1 wherein the guide extends perpendicularly inward from the inward side of the tab.

19. The cover of claim 1 wherein the tab extends downwardly and outwardly from the underside of the flap at an angle.

20. The cover of claim 1 wherein the cylindrical portion has a first recess disposed to receive the skirt extending from the spooning flap.

21. The cover of claim 20 wherein the cylindrical portion has a second recess disposed to receive the skirt extending from the shaker flap.

22. The cover of claim 21 wherein the shaker flap and the spooning flap are recessed in the top portion.

23. The cover of claim 22 wherein the skirt extending from the spooning flap and the skirt extending from the shaker flap extend downwardly and outwardly away from a central axis of the cap.

24. The cover of claim 1 wherein the guide is configured to be free of contact with the inner edge of the spooning opening when the spooning flap is in the closed position.

25. The cover of claim 1 wherein the guide is wedge-shaped.

26. The cover of claim 1 wherein the guide is a brace.

27. The cover of claim 1 further comprising a plurality of tabs and at least one guide provided on each tab.

28. The cover of claim 1 wherein the spooning flap is retained in the closed position by friction between the tab and the inner edge of the spooning opening.

29. The cover of claim 1 wherein the at least one projection comprises a single projection.

30. The cover of claim 1 wherein the at least one projection comprises a plurality of projections.

31. The cover of claim 1 further comprising at least one projection extending from the shaker flap and being configured to releasably retain the shaker flap in the closed position.

32. The cover of claim 31 wherein the projection extending from the shaker flap comprises a tab.

33. The cover of claim 32 further comprising a guide provided with the tab so that movement of the shaker flap from the open position to the closed position initially brings the guide into wedging interaction with the inner edge of at least one of the shaker openings and further movement of the shaker flap brings the tab into wedging interaction with the inner edge of the at least one shaker opening.

34. The cover of claim 33 wherein the shaker flap is retained in the closed position by the wedging interaction of the tab against the inner edge of the at least one shaker opening.

* * * * *